US009695028B2

(12) United States Patent
Bandini et al.

(10) Patent No.: US 9,695,028 B2
(45) Date of Patent: Jul. 4, 2017

(54) FILLING UNIT AND METHOD FOR FILLING AN ARTICLE WITH A POURABLE PRODUCT

(71) Applicant: Sidel S.p.A. con SOCIO UNICO, Parma (IT)

(72) Inventors: Filippo Bandini, Parma (IT); Mattia Cenci, Parma (IT); Alessandro Mameli, Parma (IT)

(73) Assignee: SIDEL S.P.A. CON SOCIO UNICO, Parma (IT)

( * ) Notice: Subject to any disclaimer, the term of this patent is extended or adjusted under 35 U.S.C. 154(b) by 198 days.

(21) Appl. No.: 14/536,584

(22) Filed: Nov. 7, 2014

(65) Prior Publication Data

US 2015/0129083 A1 May 14, 2015

(51) Int. Cl.
*B65B 43/42* (2006.01)
*B67C 3/00* (2006.01)
*B67C 3/28* (2006.01)

(52) U.S. Cl.
CPC ..... *B67C 3/007* (2013.01); *B67C 3/28* (2013.01)

(58) Field of Classification Search
CPC ..... B67C 3/007; B67C 3/28
See application file for complete search history.

(56) References Cited

U.S. PATENT DOCUMENTS 3,595,281 A * 7/1971 Laub, III ..... B67C 3/26 137/392
2001/0045242 A1 11/2001 Clusserath et al.
2003/0071237 A1* 4/2003 Johnson ..... B67C 3/28 251/340

(Continued)

FOREIGN PATENT DOCUMENTS

DE 4342142 6/1995
EP 1127835 8/2001

(Continued)

OTHER PUBLICATIONS

Extended European Search Report mailed Feb. 8, 2016, by the European Patent Office in counterpart European Patent Application No. 13192230.4 (5 pages).

(Continued)

*Primary Examiner* — Paul R Durand
*Assistant Examiner* — Randall Gruby
(74) *Attorney, Agent, or Firm* — Finnegan, Henderson, Farabow, Garrett & Dunner, L.L.P.

(57) ABSTRACT

A filling unit for contact or contactless filling an article is disclosed. The filling unit includes a tank comprising: a first valve, which may allow or prevent the fluidic connection between a first region of the tank and the article; a first fluidic line which extends from the tank to the article in case of contact filling; a second valve, which may allow or prevent the flow along the first fluidic line; and a control unit configured to set the first valve in a first closed configuration and the second valve in a second open configuration in case of contact filling. The filling unit further includes a second fluidic line distinct from the first fluidic line and extends from the inner volume of the article to a discharge area distinct from the tank; and a third valve, which may allow or prevent the flow along the second fluidic line.

10 Claims, 6 Drawing Sheets

(56) References Cited

U.S. PATENT DOCUMENTS

2003/0155384 A1* 8/2003 Nagahata ..... B67C 3/281
222/504
2004/0099319 A1* 5/2004 Monti ..... B67C 3/28
137/625.46
2005/0217753 A1* 10/2005 Krulitsch ..... B67C 3/06
141/146
2006/0266003 A1* 11/2006 Topf ..... B67C 3/007
53/281
2007/0107801 A1* 5/2007 Cochran ..... B65B 3/36
141/153
2008/0223477 A1* 9/2008 Stocchi ..... B67C 3/242
141/1
2009/0038710 A1* 2/2009 Conforti ..... B67C 3/007
141/192
2010/0071475 A1* 3/2010 Hausladen ..... B67C 3/007
73/861.04
2011/0197996 A1* 8/2011 Clusserath ..... B67C 3/001
141/311 R
2014/0215965 A1* 8/2014 Clusserath ..... B67C 3/02
53/167
2014/0239209 A1* 8/2014 Bandini ..... B67C 3/286
251/65
2015/0013833 A1* 1/2015 Clusserath ..... B67C 3/06
141/5
2015/0183538 A1* 7/2015 Cenci ..... B65B 3/04
53/281

FOREIGN PATENT DOCUMENTS

EP 1 216 952 A2 6/2002
EP 1580160 9/2005
JP 2002 211689 7/2002

OTHER PUBLICATIONS

European Search Report in EP 13192230, mailed Mar. 28, 2014 (7 pages).

* cited by examiner

FILLING UNIT AND METHOD FOR FILLING AN ARTICLE WITH A POURABLE PRODUCT

CROSS-REFERENCE TO RELATED APPLICATIONS

This application claims the benefit of priority of European Patent Application No. 13192230.4, filed Nov. 8, 2013, which is incorporated herein by reference.

The present invention relates to a filling unit for contact or contactless filling an article with a pourable product, especially a pourable food product.

The present invention also relates to a filling method for contact or contactless filling an article with the pourable product, especially a pourable food product.

In greater detail, the filling device is adapted either to fill the article with a carbonated food product, i.e. a food product containing carbon dioxide, according to a contact modality or to fill the article with a still pourable product according a contactless modality.

BACKGROUND OF THE INVENTION

Known article-handling machines comprise a filling station fed with empty articles and adapted to output articles filled with the pourable food product.

The filling unit substantially comprises a carousel conveyor rotating about a rotation axis, a tank containing the pourable food product, and a plurality of filling devices supported by the carousel conveyor in a position radially external with respect to the rotation axis of the carousel conveyor.

In greater detail, the carousel is provided with a plurality of support elements for respective articles provided to arrange the mouths of respective articles in a lower position with respect to the respective filling devices and to displace the articles along a circumferential arc trajectory about the above said rotation axis integrally to the respective filling devices.

Each filling device essentially comprises a fixed body connected to the carousel and a valve sliding with respect to the fixed body between an open configuration and a closed configuration.

In greater detail, when it is arranged in the open configuration, the valve defines an opening with the fixed body. The pourable product thereby flows from the tank to a filling mouth of the relative article passing through the opening.

Differently, when the valve is arranged in the closed configuration, it sealingly cooperates with an abutment surface defined by the fixed body, thus preventing the pourable product from flowing from tank towards the mouth of the relative article.

In case of contact filling of carbonated products, the mouth of each article is tight-fluid pressed against the body of the respective filling device. In this way, the carbon dioxide contained in the food product is prevented from escaping from the article in the environment.

Differently, in case of contactless filling of still products, the body of the filling device is arranged at a given distance from the mouth of the article to be filled.

Furthermore, in the case of contact filling with carbonated food products, the filling device is required to carry out a plurality of additional operations on the articles, in addition to the filling with the pourable food product.

In greater detail, the articles undergo a pressurization operation before the filling thereof with the pourable food product. Still more precisely, the empty articles are filled with a pressurized gas, so as to render the pressure inside the articles equal to the pressure of the pourable product, during the filling operation.

Furthermore, due to the fact that the inner volume of each article is in tight-fluid contact with the body of the respective filling device, the latter is required to allow the gas contained in the articles to escape during the filling of the articles.

In order to meet all these needs, filling device s are known, for example from US-A-2001/0045242, which comprises:

- a filling chamber defined by the body and fluidly connected to a lower portion of the tank filled with the pourable food product; and
- a return duct surrounded by the filling chamber and which opens towards the mouth of the article.

When the valve is in the closed configuration, the filling chamber is divided in a upper part filled with the pourable product and a lower part which faces the mouth of the article.

Furthermore, the filling device shown in US-A-2001/0045242 comprises:

- a fluidic line which extends from an upper portion of the tank filled with a pressurized gas, e.g. carbon dioxide or nitrogen dioxide, to the lower part of the filling chamber of the filling device;
- a pressurization chamber, which is interposed along the fluidic line; and
- a plurality of control valves, which can be controlled to fluidly connect the pressurization chamber with the lower part of the filling chamber before the filling of the article.

Furthermore, the control valves can be controlled to fluidly connect the return duct with the pressurization chamber, during the filling of the article.

In case of filling with carbonated products, the valve is kept in the closed configuration while the mouth of the article is in tight-fluid contact with the body of the filling device, and the control valves are controlled to allow the flow of the pressurized gas from the upper part of the tank towards the lower part of the filling device.

In this way, the article is pressurized before the filling thereof.

At this stage, the control valves are controlled to prevent the pressurized gas from flowing towards the filling device, and the valve is set in the open configuration.

Accordingly, the food product flows inside the inner volume of the article while the gas contained in the article flows back in the return duct and in the fluidic line towards the pressurization chamber and the upper part of the tank.

As a result, during the filling of the article, the gas previously contained in the article mixes inside the pressurization chamber and the fluidic line with the gas coming from the tank and that has not yet reached the article.

The gas that returns back along the return duct has been in contact with the article and, therefore, contains a certain amount of impurities. As a result, the gas with some impurities coming from the duct contaminates inside the chamber the "clean" pressurized gas coming from the upper part of the tank.

Accordingly, the pressurized gas which eventually pressurizes the inner volume of the article inevitably contains some impurities.

There is, therefore, the risk of contaminating the article during the pressurization thereof, thus generating the risk of contaminating also the food product with which the article will be subsequently filled.

A need is felt within the industry to reduce as far as possible that risk of contaminating the food product.

Furthermore, the filling device also needs to de pressurize the article, after that the filling thereof with the food product has been completed.

A need is felt within the industry to reduce as far as possible the risk that the gas coming out from the articles contaminates the gas which eventually will be injected in the articles.

SUMMARY OF THE INVENTION

It is an object of the present invention to provide a filling device for contact or contactless filling an article with a pourable product, which allows to easily and cost-effectively meet at least one of the above said needs.

The aforementioned object is achieved by the present invention as it relates to a filling device for contact or contactless filling device for filling an article with a pourable product, as defined in claim 1.

The present invention also relates to a method for contact or contactless filling an article with a pourable product, as defined in claim 12.

BRIEF DESCRIPTION OF THE DRAWINGS

One preferred embodiments is hereinafter disclosed for a better understanding of the present invention, by way of non-limitative example and with reference to the accompanying drawings, in which.

DETAILED DESCRIPTION OF THE INVENTION

Figure 1:
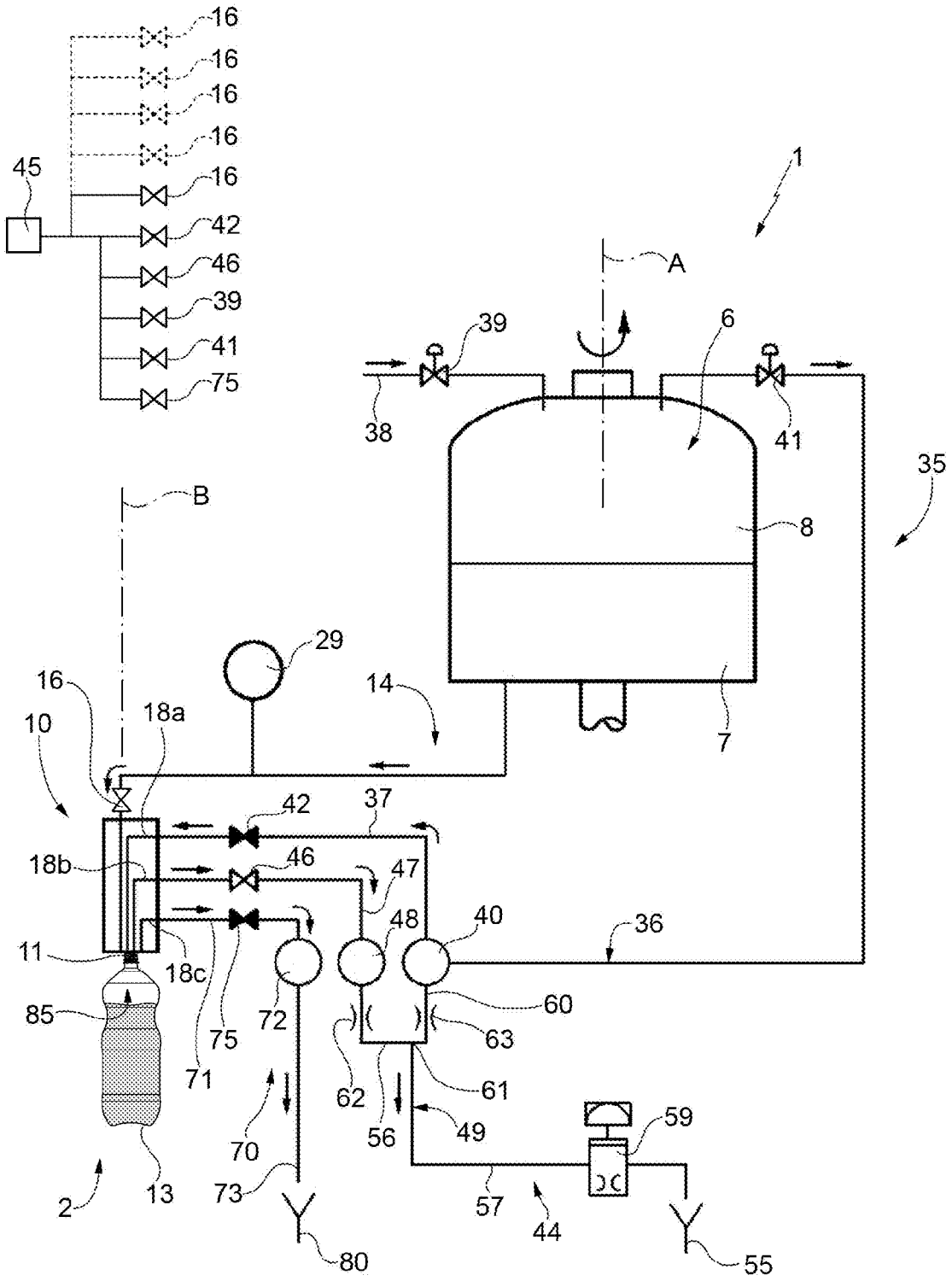
FIG. 1 shows a schematic view of a filling unit according to the present invention during a contact filling operation, with parts removed for clarity.

With reference to FIGS. 1 to 6, numeral 1 indicates a filling unit for filling articles 2 with a pourable product.

Filling unit 1 is adapted either to contactless fill article 2 with a still food product or to contact fill article 2 with a carbonated food product, i.e. a food product containing carbon dioxide.

In greater detail, filling unit 1 essentially comprises (FIGS. 5 and 6):

- a carousel 3 rotating about an axis A, which is vertical in the case shown, along an arc-shaped path P extending from an input station I to an output station O; and
- a plurality of filling devices 10 adapted to fill respective articles 2 with the pourable food product and supported by a peripheral edge external to axis A of carousel 3.

Carousel 3 also includes a tank 6 common to all filling devices 10 and which comprises a lower portion 7 filled with the pourable food product at a pressure higher than environment pressure and an upper portion 8 filled with a gas.

In particular, gas is a pressurization gas, e.g. carbon dioxide, in case of contact filling of carbonated products. In this case, the gas is flown inside article 2 before the filling thereof, so as to render equal the pressure in the inner volume of articles 2 and the pressure of the pourable product inside portion 7 of tank 6.

In case of contactless filling of still products, the food product contacts the outer environment. Accordingly, it is necessary to ensure the asepticity of the food product. To this end, the gas contained in portion 8 is typically air or nitrogen and is flown through portion 8 of tank 6, so as to prevent contaminant substances to enter inside tank 6 and to contaminate the pourable food product.

Each article 2 comprises (FIGS. 1 to 4):

- a mouth 11 adapted to allow the filling of article 2 by means of filling unit 1 and the following pouring of the food product from article 2;
- a neck 12 arranged immediately below mouth 11; and
- a bottom wall 13 opposite to mouth 11.

For simplicity, the following description will refer to only one filling device 10 and to relative article 2, as devices 10 are identical to one another.

Filling device 10 essentially comprises (FIGS. 3 and 4):

- a frame 15 fitted to carousel 3;
- a hollow body 19 which is defined by frame 15 and which extends about an axis B parallel to and staggered from axis A;
- a valve 16 movable along axis B inside body 19; and
- a gripping device 17 movable along axis B towards and away filling device 10 and configured to grip neck 12 of article 2.

Gripping device 17 is movable together and synchronously with filling device 10 and carousel 3 about axis A.

Figure 3:
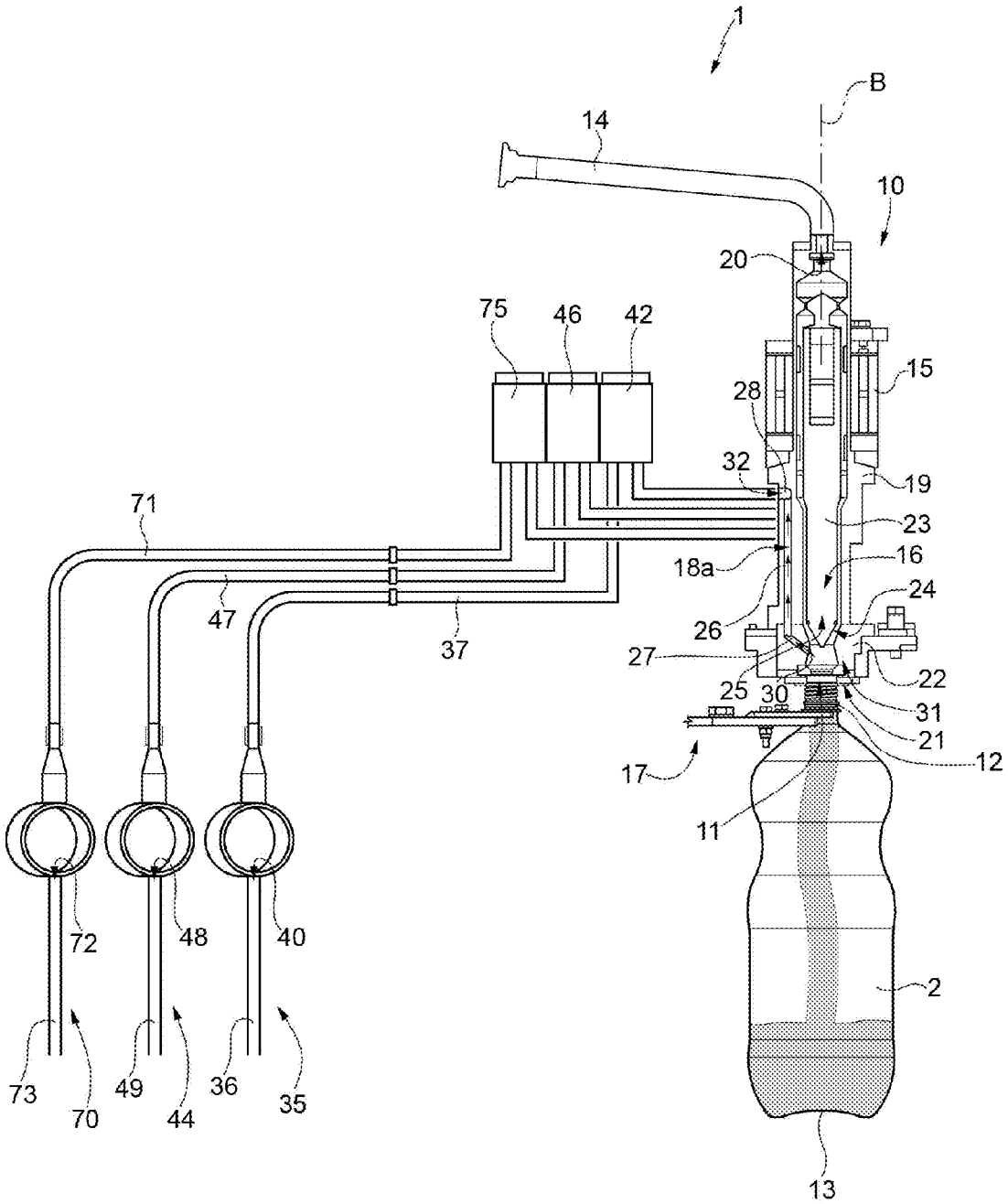
FIG. 3 shows a schematic view of the filling unit of FIG. 1 during the contact filling operation, with parts removed for clarity.
Figure 4:
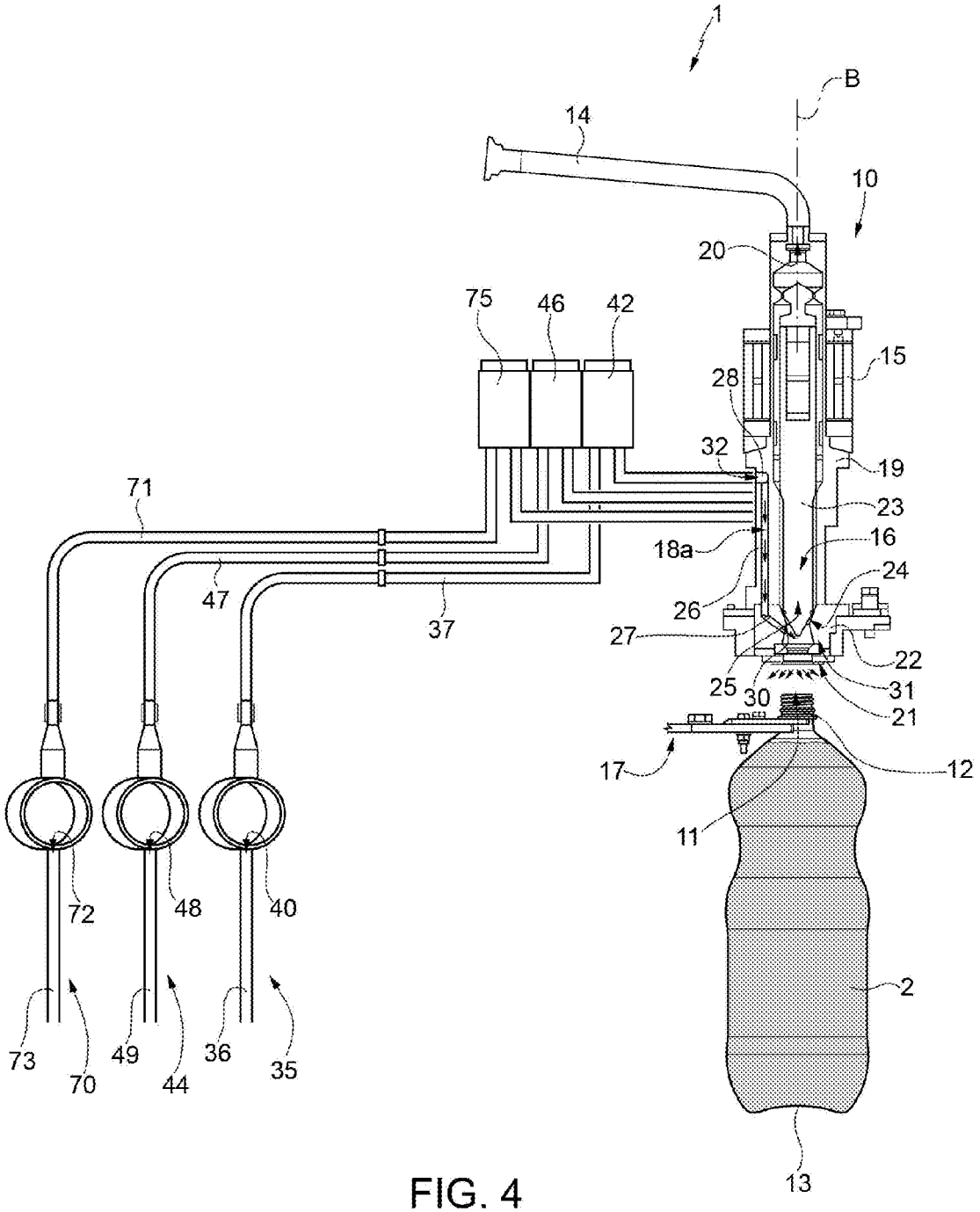
FIG. 4 shows in section some components of the filling unit of FIGS. 1 to 3 during the contact filling operation, with parts removed for clarity.
Figure 5:
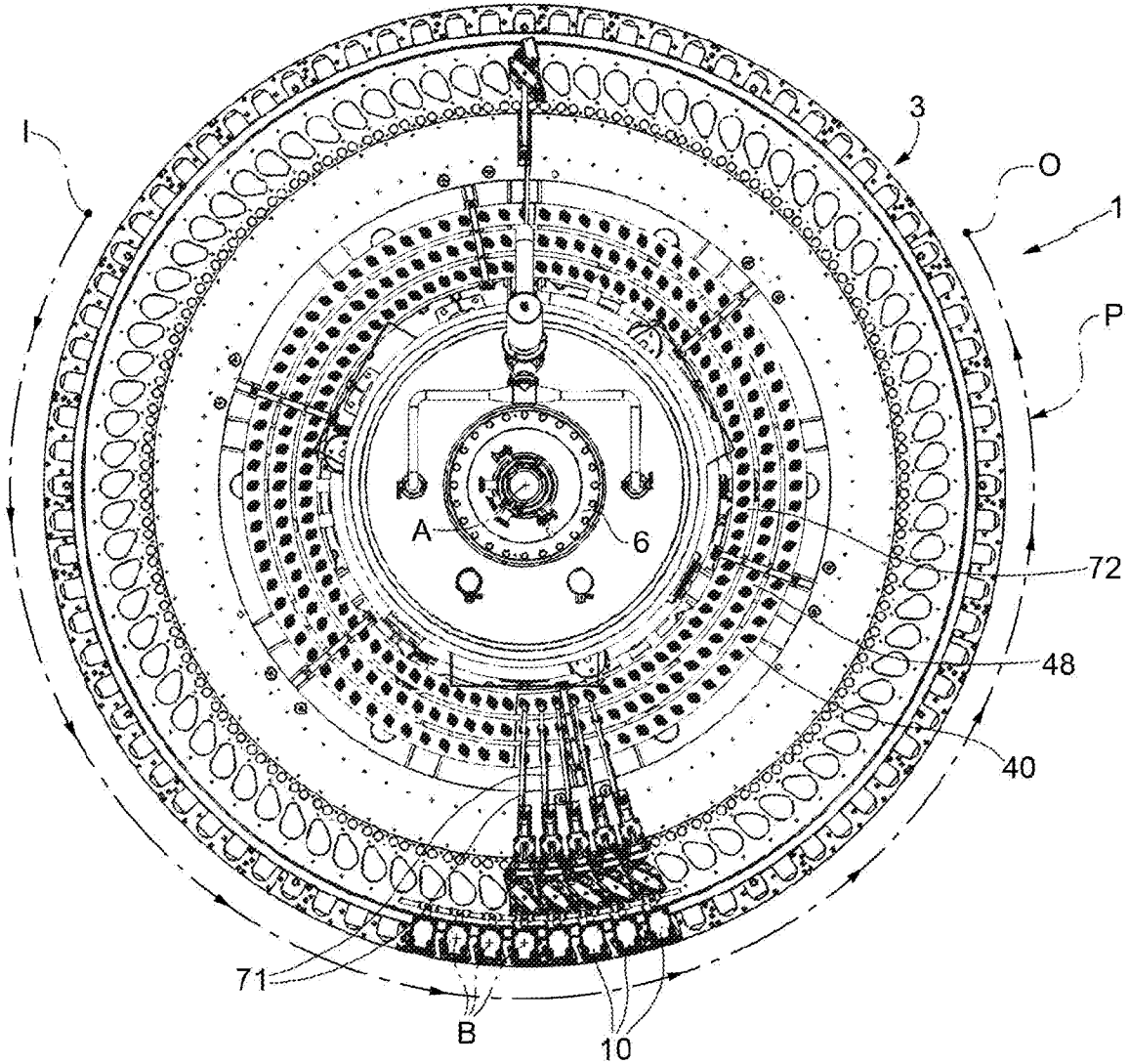
FIG. 5 is a top view of the filling unit of FIGS. 1 to 4.
Figure 6:
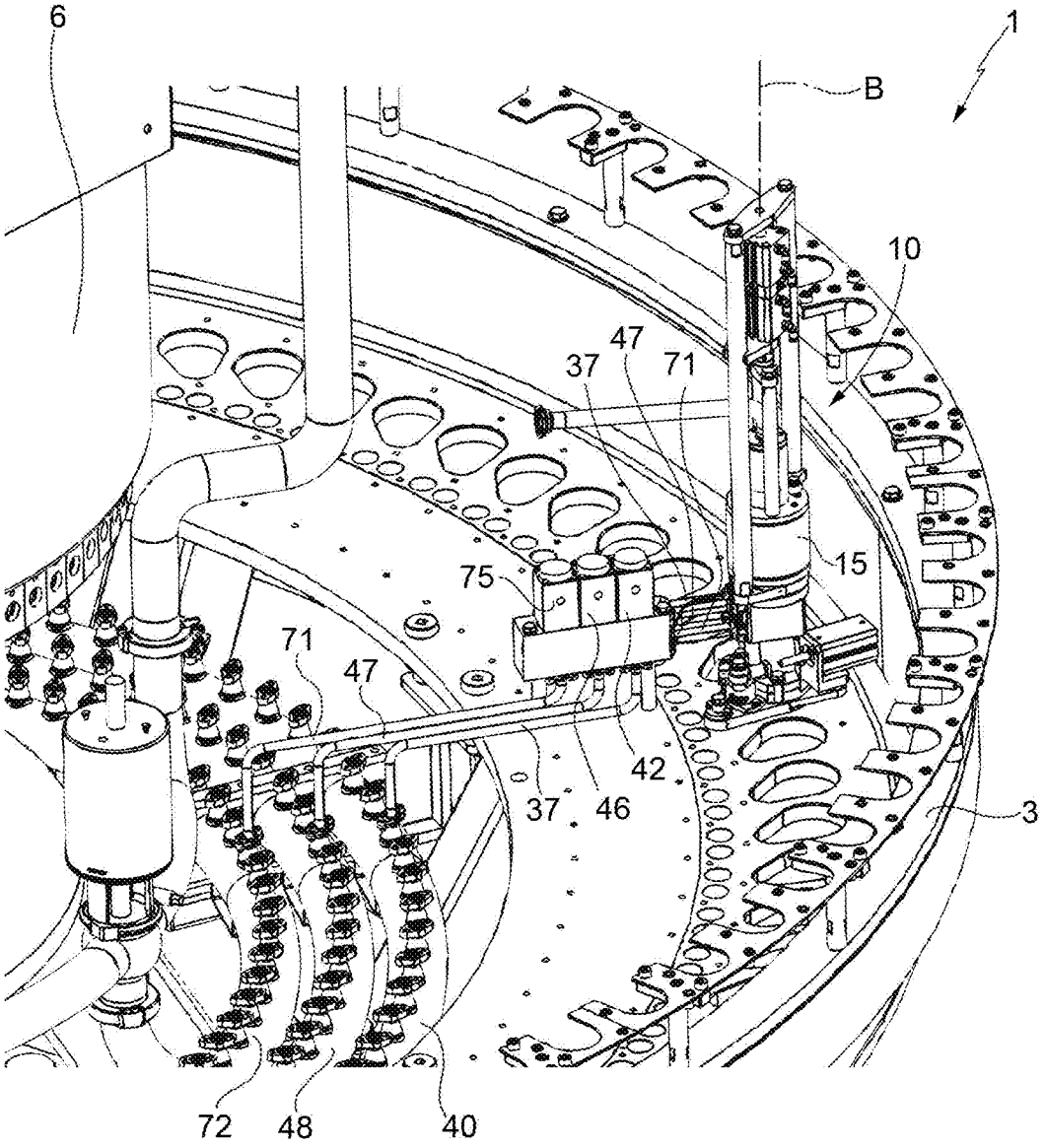
FIG. 6 is a perspective view of the filling unit of FIGS. 1 to 5, with parts removed for clarity.

Furthermore, gripping device 17 is movable parallel to axis B between:

- a lowered rest position (not-shown); and
- a raised operative position, in which article 2 undergoes a certain number of operations (shown in FIGS. 3 and 4).

Still more precisely, gripping device 17 moves from the lowered rest position to the raised operative position at station I and moves from the raised operative position to the lowered rest position at station O.

Body 19 comprises, in turn, proceeding along axis B:

- an opening 20, which is fluidly connected with lower portion 7 of tank 3;
- an annular protrusion 22, which protrudes towards axis B and defines a conical passage 24 (shown in FIG. 3);
- an opening 21, which is opposite to opening 20, which faces mouth 11 of article 2 and through which the food product passes during the filling of article 2; and
- a cavity 31 which is interposed along axis B between protrusion 22 and opening 21, and which is bounded, on the opposite side of protrusion 22, by opening 21.

In particular, filling unit 1 comprises, for each filling device 10, a fluidic line 14 interposed between lower portion 7 of tank 6 and openings 20 of filling devices 10, and along which a flow-sensor 29, a flow-meter in the embodiment shown, is arranged.

Protrusion 22 is axially interposed between openings 20, 21, proceeding along axis B.

Due to the fact that passage 24 is, in a section orthogonal to axis B, shaped as a circle, the food product creates a cylindrical flow of axis B, during the filling of article 2.

In the embodiment shown, valve 16 comprises:

- a stem 23 which receives a force along axis B; and
- a plunger 25 which is arranged at an end of stem 23 arranged on the side of opening 21.

Plunger 25 is conical of axis B and comprises a conical end on the side of opening 21 shaped correspondingly to the shape of opening 21.

Furthermore, protrusion 22 is conical of axis B and tapers from opening 20 to opening 21.

Valve 16 is movable relative to body 19 and along axis B between:

an open configuration (shown in FIG. 3), in which it allows the fluidic connection between lower portion 7 of tank 6 and opening 21, thus allowing the filling of article 2 with the food product; and a closed configuration (shown in FIG. 4), in which it prevents the fluidic connection between lower portion 7 of tank 6 and opening 21.

In the present description, the expression contact filling indicates a filling modality, in which article 2 is tight-fluidly pressed against body 19 of filling device 10 whereas the expression contactless filling indicates a filling modality, in which article 2 is spaced along axis B from body 19 of filling device 10.

In this way, the food product is prevented from contacting the outer environment in case of contact filling whereas the food product contacts the outer environment in case of contactless filling.

In the embodiment shown, when valve 16 is in the open configuration, plunger 25 is spaced from protrusion 22 and leaves free passage 24.

On the contrary, when valve 16 is in the closed configuration, plunger 25 abuts against protrusion 22 and seals passage 24.

Furthermore, mouth 11 of article 2 is tight-fluidly pressed against opening 21 of filling device 10 in case of contact filling, when gripping device 17 is in the raised position.

On the contrary, mouth 11 of article 2 is spaced along axis B from opening 21 of filling device 10 in case of contactless filling, when gripping device 17 is in the raised position.

Body 19 also comprise a plurality, three in the embodiment shown, of ducts 18*a*, 18*b*, 18*c* (only schematically shown in FIGS. 1 and 2), which extend eccentrically to and on one side only of axis B and are arranged radially outer than valve 16 with respect to axis B (see FIGS. 3 and 4).

In detail, each duct 18*a*, 18*b*, 18*c* comprises an end opening 30. Openings 30 open inside body 19 in a position axially interposed along axis B between protrusion 22 and opening 21, i.e. inside cavities 31.

In this way, openings 30 are in fluid connection with mouth 11 of article 2, even when valve 16 is in the closed configuration.

In the embodiment shown, each duct 18*a*, 18*b*, 18*c* comprises:

a main portion 26 extending parallel to axis B;

an end portion 27, which is housed inside protrusion 22 and defines opening 30; and an end portion 28, which is opposite to portion 26 and defines an opening 32, the function of which will be explained in the following of the present description.

Portion 27 converge towards axis B on the opposite side of portion 26, in the embodiment shown.

Portion 28 is, in the embodiment shown, radial to axis B.

Filling unit 1 also comprises (FIGS. 1 and 2) a plurality of fluidic lines 35, which are adapted to selectively convey the pressurization gas from upper portion 8 of tank 6 inside the inner volume of relative articles 2, in case of contact filling.

Still more precisely, fluidic lines 35 comprise:

a common portion 36, which originates from portion 8 of tank 6 and which is common to all filling devices 10;

a pressurization chamber 40, which is common to all filling devices 10;

relative portions 37, which are associated to respective filling devices 10 and interposed between chamber 40 and openings 32 of relative duct 18*a*; and relative ducts 18*a* associated to respective filling devices 10, which are in fluidic connection with the inner volumes of respective articles 2, in case of contact filling thereof.

Filling unit 1 also comprises:

a valve 41 common to all the filling devices 10 and interposed along portion 36 of filling lines 35 between upper portion 8 and chamber 40; and a plurality of valves 42 associated to relative filling devices 10 and interposed, each, along portion 37 of relative fluidic line 35.

Valve 41 may be selectively arranged in:

an open configuration, in which it allows the gas contained in upper portion 8 of tank 6 to flow along portion 36 and towards chamber 40; and a closed configuration, in which it prevents the gas contained in upper portion 8 of tank 6 from flowing along portion 36 and towards chamber 40.

Each valve 42 may be selectively arranged in:

an open configuration, in which it allow the gas contained in upper portion 8 of tank 6 to flow from chamber towards relative duct 18*a* and, therefore, relative article 2; and a closed configuration, in which it prevents the gas contained in upper portion 8 of tank 6 from flowing from chamber 40 towards relative duct 18*a* and, therefore, relative article 2.

Filling unit 1 also comprises a control unit 45 (only schematically shown in FIGS. 1 and 2) configured to control valves 41, 42 and valves 16 of filling device 10 in such a way to pressurize articles 2 with gas contained in upper portion 7 of tank 6, before the contact filling of articles 2 with carbonated food product.

To this end, control unit 45 is configured, in case of contact filling of articles 2 with carbonated food product, to:

keep valves 16 of each filling device 10 in respective closed configuration; and set valves 41, 42 in respective open configurations, so as to allow the gas contained in upper portion 8 of tank 6 to flow along fluidic lines 35 and to reach openings 20 and mouths 11 of articles 2 to be filled.

Filling unit 1 also comprises (FIGS. 1 and 2):

a duct 38 for feeding upper portion 8 of tank 6 with the gas; and a valve 39 arranged along duct 38 upstream of tank 6 and controllable to adjust the amount of gas which enters tank 6.

Advantageously, filling unit 1 comprises, for each filling device 10 and corresponding article 2:

a plurality of fluidic lines 44 for allowing the escaping of the gas contained inside respective articles 2 during the contact filling thereof, which are distinct from fluidic lines 35, and extends from inner volume of article 2 to a discharge 55 distinct from tank 6; and a plurality of valves 46, which may be selectively set in respective open configurations in which they allow the gas contained in the inner volumes of articles 2 to flow along respective fluidic lines 44 or in respective closed configurations in which they prevent the gas contained in articles 2 from flowing along respective fluidic lines 44;

control unit 45 is configured to set valve 16 of each filling device 10 in the respective open configuration and respective valve 46 in the respective open configuration in case of contact filling of respective article 2, so as to allow the gas contained in article 2 to be discharged during the filling of article 2.

In greater detail, in case of contact filling of articles 2, each fluidic line 35 is fluidly isolated from corresponding fluidic line 44, i.e. the gas coming out from each article 2 along respective fluidic line 44 is prevented from reaching corresponding fluidic lines 35.

As it will be evident from the following of the present description, fluidic lines 35, 44 are not required to be physically isolated from one another, but a preferential flow of the gas contained in upper portion 8 of tank 6 is established (as indicated by arrows in FIGS. 1 and 2):

- from portion 8 of tank 6 towards inner volume of articles 2 along respective fluidic lines 35 before the contact filling of articles 2; and
- from inner volume of articles 2 towards discharge 55 and along respective fluidic lines 44 during the contact filling of articles 2.

In greater detail, fluidic lines 44 comprises, proceeding from the inner volume of relative articles 2 towards discharge 55:

- relative ducts 18*b* of respective filling device 10 and which are in fluidic communication with the inner volume of relative articles 2, in case of contact filling;
- relative portions 47 associated to respective filling devices 10 and which originates from openings 32 of relative ducts 18*b;*
- a return gas chamber 48, which is common to all filling devices 10; and
- a portion 49, which is common to all filling devices 10 and which extends from return gas chamber 48 to discharge 55.

Each valve 46 is, in the embodiment shown, interposed along a relative portion 47 of the corresponding fluidic line 44.

Filling unit 1 comprises a duct 60, which is interposed between pressurization chamber 40 and portion 49, and is connected to portion 49 at a connection point 61.

Still more precisely, common portion 49 of fluidic lines 44 comprises, proceeding from return gas chamber 48 to discharge 55:

- a segment 56 which extends from return gas chamber 48 to connection point 61; and
- a segment 57 which extends from connection point 61 and discharge 55.

Preferably, filling unit 1 further comprises:

- a concentrated hydraulic loss 62 arranged along segment 56 of fluidic line 44; and
- a concentrated hydraulic loss 63 arranged along duct 60.

Losses 62, 63 are throttling s, in the embodiment shown.

Pressurization chamber 40 is at a first value of pressure, return gas chamber 48 is at a second value of pressure and discharge 55 is a third value of pressure.

The first value of pressure is greater than the second value of pressure, and the second value of pressure is greater than the third value of pressure.

The difference of pressure between pressurization chamber 40 and return gas chamber 48 is generated by the distributed hydraulic losses along segment 56 and duct 60, and by the concentrated hydraulic losses 62, 63.

As a result of this difference of pressure between pressurization chamber 40 and return gas chamber 48, during contact filling of articles 2 (FIGS. 1 and 3), the gas contained in return gas chamber 48 is substantially prevented from moving along duct 60 and is substantially forced to move along segment 57 towards discharge 55, as indicated by arrows in FIG. 1.

In other words, the gas preferentially moves from chamber 40 to inner volumes of article s 2 before the contact filling thereof, and from the inner volumes of article 2 to return gas chamber 48 and from return gas chamber 48 to discharge 55 before the contact filling of articles 2.

It is important to point out that the above-identified differences between the first value and the second value of pressure is constant for a wide range of variation of the first and the second pressure of pressurization chamber 40 and of return gas chamber 48.

Filling unit 1 also comprises a modulating valve 59 which is interposed along fluidic line 44 and adapted to generate a counter-pressure at the end of fluidic line 44.

In the embodiment shown, modulating valve 59 is interposed along portion 49 of filling line 44.

In case of contactless filling of articles 2, control unit 45 is programmed for controlling valves 39, 41 in such a way that a substantially constant amount of gas passes through portion 8 of tank 6, thus ensuring the asepticity of the food product contained inside portion 7 of tank 6.

Furthermore, control unit 45 is programmed to set, during the contactless filling of articles 2, corresponding valves 42 in the respective open configuration, so as to allow the gas coming out along fluidic line 35 to discharge from opening 30 of duct 18*a* inside cavities 31 and, then, inside, the outer environment (FIG. 3).

Still more precisely, the gas coming from upper portion 8 of tank 6 is discharged in the area between openings 21 of filling devices 10 and relative mouths 11 of articles 2, which are arranged at a given distance along axis B from respective filling devices 10.

Preferably, control unit 45 is also programmed to set, during the contactless filling of articles 2, also corresponding valves 46 in the respective open configurations, so as to allow the gas coming out along fluidic line 35 to discharge from openings 30 of ducts 18*b* inside cavities 31 and, then, inside the outer environment through openings 21 (FIG. 3).

Still more precisely, the gas coming from upper portion 8 of tank 6 is discharged in the area between openings 21 of filling devices 10 and relative mouths 11 of articles 2, which are arranged at a given distance along axis B from respective filling devices 10.

Furthermore, filling unit 1 comprises:

- a plurality of fluidic lines 70, which allow the de-pressurization of articles 2 at the end of contact filling thereof and before they are discharged at station O; and
- a plurality of valves 75 interposed along respective fluidic lines 70, and which can be set in respective open configurations in which they allow the gas present in the head-spaces 85 of relative articles 2 to be discharged in drain 80 along relative fluidic lines 70 or in respective closed configurations in which they prevent the gas present in the head-spaces 85 of relative articles 2 from flowing along relative fluidic lines 70 to a drain 80.

In detail, each fluidic line 70 extends between opening 32 of duct 18*c* to a drain 80 at the atmospheric pressure.

Fluidic lines 70 comprise, proceeding from opening 30 of ducts 18*c* to drain 80:

- respective ducts 18*b* of respective filling devices 10 and which are in fluidic connection with the head space of relative articles 2, in case of contact filling;

respective portions 71 associated to respective filling devices 10 and starting from respective openings 32 of ducts 18*c;* a de-pressurization chamber 72, which is common to all filling devices 10; and a portion 73, which is common to all filling devices 10 and which extends from de-pressurization chamber 72 to drain 80.

Valves 75 are interposed between ducts 18*c* and respective portions 71.

Control unit 45 is programmed for:

setting valves 75 in respective closed configurations when valves 16 of respective filling devices 10 are in the relative open configuration s, during the contact filling of the articles 2; and setting valves 75 in respective open configuration s when valves 16 of respective filling devices 10 are in the relative closed configurations, after the completion of the contact filling of articles 2 and with the latter still in tight-fluid contact with relative filling devices 10.

In the embodiment shown, pressurization chamber 40, return gas chamber 48 and de-pressurization chamber 72 are annular about axis A.

Finally, in the embodiment shown, valves 42, 46, 75 are on-off valves.

The operation of filling unit 1 will be firstly described with reference to a contact filling operation with a carbonated product and with reference to only one filling device 10 and respective only one article 2 and only one gripping device 17, and to only one respective filling line 35, 44, 70 (FIGS. 1 and 3).

Portion 8 of tank 6 is filled with a pressurization gas, e.g. carbon dioxide while portion 7 of tank 6 is filled with the food product with which article 2 will be filled. In particular, the pressure of the food product inside portion 7 of tank 6 is greater than the environment pressure.

Carousel 3 is fed with empty article 2 at inlet station I, advances it along path P along which article 2 is filled with the carbonated food product and discharges the filled article 2 at outlet station O.

Gripping device 17 synchronously rotates about axis B integrally with filling device 10.

Still more precisely, gripping device 17 grips neck 12 of article 2 and moves from the lowered position to raised position at station I, and from the raised position to the lowered position at station O.

When article 2 is in the raised position, mouth 11 of article 2 is sealingly pressed against body 19 of filling device 10. Accordingly, mouth 11 is fluidly connected to opening 21 of filling device 10 and with openings 32 of ducts 18*a*, 18*b*, 18*c*.

As it moves along path P, filling device 10 carries out on article 2 the subsequently following operations:

pressurization of empty article 2 with the pressurized gas, in order to render the pressure in the inner volume of article 2 equal to the pressure of the food product in portion 7 of tank 6;

filling of article 2 with the food product; and de-pressurization of head-space 85 of article 2 to the environmental pressure, in order to avoid the foaming of the food product and/or the explosion of article 2.

In greater detail, when filling device 10 is at station I, control unit 45 sets valve 41 in the open configuration and sets valve 16 and valves 42, 46 and 75 in respective closed configurations.

During the pressurization step, control unit 45 sets valve 42 in the open configuration, thus allowing the pressurizing gas contained in portion 8 of tank 6 to flow along fluidic line 35.

In greater detail, the pressurizing gas flows from portion 8 to pressure chamber 40 along portion 36 of fluidic line 35, and from pressure chamber 40 to opening 30 of ducts 18*a* along portion 37 and duct 18*a* of the fluidic line 35.

Due to the fact that opening 30 of duct 18*a* and the inner volume of article 2 are in fluidic connection with cavity 31, when valve 16 is in the closed configuration and mouth 11 of article 2 is pressed against body 19 of filling device 10, the pressurizing gas can fill and pressurize the inner volume of article 2.

When the pressurization of the inner volume of article 2 has been completed, control unit 45 sets valves 41, 42 in the closed configuration, and sets valve 46 and valve 16 of filling device 10 in the respective open configuration.

In this way, the food product can flow through passage 24 and opening 21 inside the inner volume of article 2, thus filling the latter.

At the same time, the gas contained inside the inner volume of article 2 passes through fluidic line 44 and reaches discharge 55.

In greater detail, the gas contained inside the inner volume of article 2 enters opening 30 of duct 18*b*, flows along ducts 18*b*, portion 47, return chamber 48 and portion 49, and reaches discharge 55.

Due to the presence of concentrated hydraulic losses 62, 63 and of the distributed hydraulic losses along segment 56 of portion 49 and duct 60, return gas chamber 48 is kept at the second pressure value, which is lower than the first pressure value at which pressurization chamber 40 is kept.

Moreover, the difference between the first pressure value and the second pressure value is kept constant.

Furthermore, thanks to the fact that the first value of pressure is higher than the second value of pressure and higher than the third value of pressure of discharge 55, the gas coming out from the inner volume of article 2 is substantially prevented from flowing along duct 60 and, therefore, from reaching pressure chamber 40, as indicated in FIG. 1.

When sensor 29 has detected that the desired amount of pourable product has filled article 2, control unit 45 sets valve 16 and valve 42 in the closed configuration and, subsequently, sets valve 75 in the open configuration.

As a result, the gas contained in head-space 85 of article 2 can flow along fluidic line 70 and reach de-pressurization chamber 72 and, then, discharge 55. In this way, head-space 85 of article 2 is de-pressurized to the environment pressure.

Filled article 2 with head-space at the environment pressure can be now discharged at station O, without risk of foaming of the food product and/or explosion of article 2.

Figure 2:
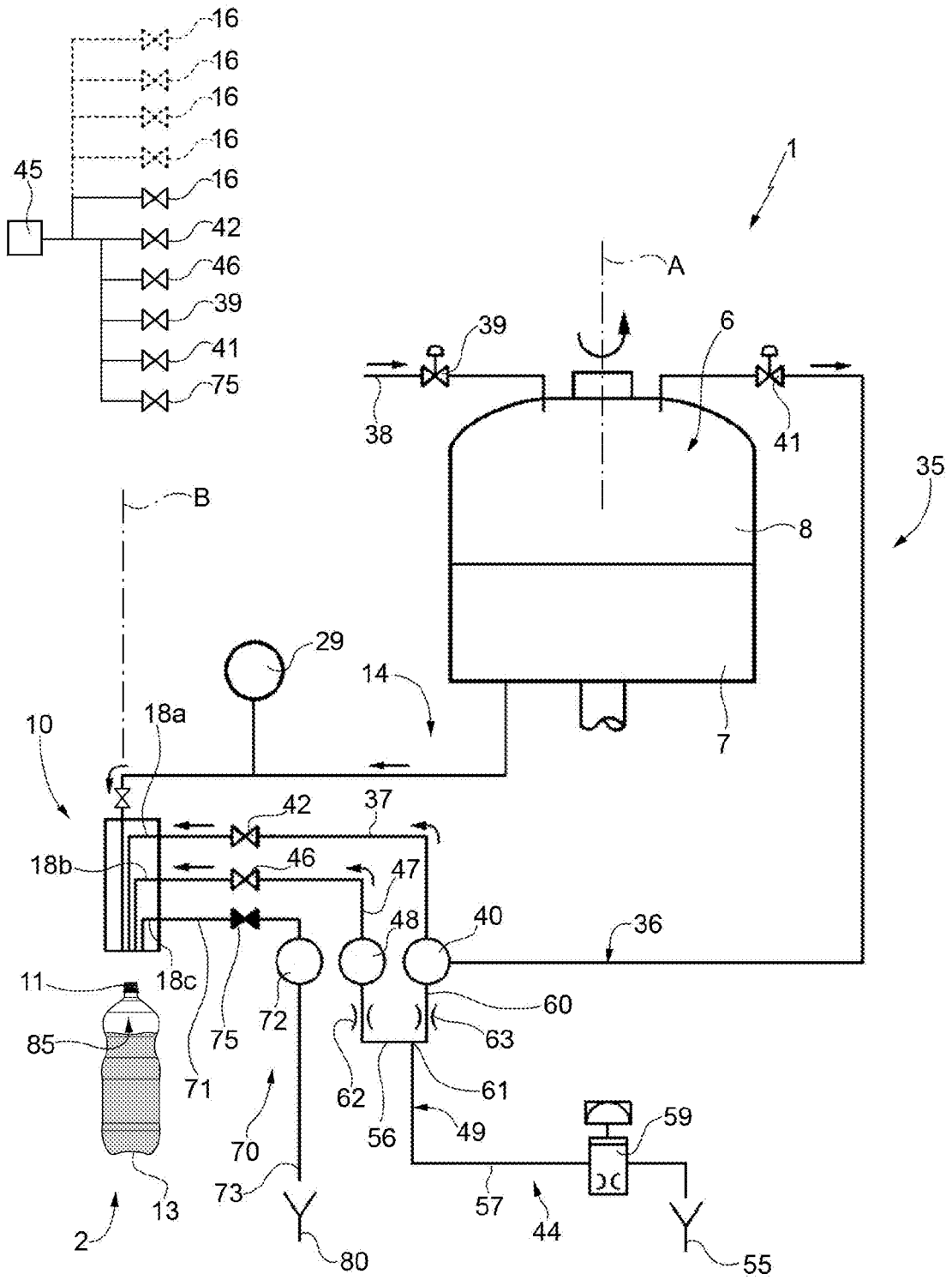
FIG. 2 shows in section some components of the filling unit of FIG. 1 during the contactless filling operation, with parts removed for clarity.

The operation of filling unit 1 will be now described with reference to a contactless filling operation with a still product and with reference to only one filling device and respective only one article 2, and to only one respective filling line 35, 44, 70 (FIGS. 2 and 4).

In particular, portion 8 of tank 6 is filled with a gas, i.e. carbon dioxide or nitrogen, while portion 7 of tank 6 is filled with the food product with which article 2 will be filled.

Carousel 3 is fed with empty article 2 at inlet station I, advances it along path P along which article 2 is filled with the carbonated food product and discharge s the filled article 2 at outlet station O.

Still more precisely, gripping device 17 rotates about axis A and grips neck 12 of article 2 and moves from the lowered position to raised position at station I, and from the raised position to the lowered position at station O.

When article 2 is in the raised position, mouth 11 of article 2 is spaced along axis B from body 19 of filling device 10. Accordingly, openings 30 of ducts 18*a*, 18*b*, 18*c* and cavities 31 are in fluid contact with the environment surrounding filling device 10.

Control unit 45 sets valve 16 in the open configuration, and sets valves 41, 46 and 75 in the respective closed configurations.

In this way, valve 16 is spaced along axis B from protrusion 22 and the food product is free to pass through passage 24 and opening 21. The food product, then, fall for gravity inside empty article 2.

When sensor 29 has detected that article 2 has been filled with the correct amount of food product, control unit 45 sets valve 16 in the closed configuration.

Due to the fact that the food product contacts the environment during the contact filling, it is necessary to ensure that the food product contained in portion 7 of tank 6 is kept at a certain degree of asepticity.

To this end and with valve 16 kept in the closed configuration, control unit 45 controls valves 39, 41, so as to generate a continuous constant flow of gas through portion 8 of tank 6 and along portion 36 of fluidic line 35. That flow prevents contaminant agents from entering inside portion 7 of tank 6 and contaminating the food product.

In order to discharge that flow of gas coming out from portion 8 of tank 6, control unit 45 sets valve 42 in the respective open configuration.

In this way, the gas coming out from portion 8 of tank 6, due to its pressure value, can flow along the whole fluidic line 35 up to opening 30 of duct 18*a*. Then, the gas coming out from portion 8 passes through cavity 31 and opening 21 of filling device 10 and eventually discharges in the outer environment, as shown in FIG. 3.

Preferably, control unit 45 also sets valve 46 in the respective open configuration, in order to discharge the gas coming out from portion 8 of tank 6.

In this way, the gas coming out from portion 8 of tank 6, due to its pressure value, can also flow along duct 60 towards connection point 61 and from connection point 61 towards return chamber 48 towards segment 56. Then, the gas coming out from portion 8 of tank 6 flows along portion 56 and duct 18*b*. Finally, that gas discharges from duct 18*b* inside cavity 31 of body 19 and in the environment surrounding filling device 10.

From an analysis of the features of filling unit 1 and of the method according to the present invention, the advantages it allows to obtain are apparent.

In particular, fluidic lines 44 are distinct from fluidic lines 35 and discharge return gas in discharge 55 distinct from tank 6, in case of contact filling of article 2 with carbonated product.

Accordingly, the return gas coming out for articles 2 is prevented from mixing with the gas coming out from portion 8 of tank 6 and intended to pressurize articles 2.

There is, therefore, substantially no risk that gas which has contacted articles 2 and flow s along fluidic lines 44 contaminates the gas which has still to pressurize article 2 and which flows along fluidic lines 35.

As a result, the asepticity of the pourable product is highly enhanced when compared with the known solution discussed in the introductory part of the present description.

It is also important to note that fluidic lines 35, 44 are not physically isolated, but are, in a preferred embodiment of the invention, connected by duct 60.

On one hand, duct 60 together with hydraulic losses 56, 57 is effective in keeping a constant pressure difference between the higher first pressure value in pressure chamber 40 and the lower second pressure value in return chamber 48, regardless the punctual values of the first pressure and the second pressure values.

On the other hand, the distributed hydraulic losses along duct 60 and segment 56 as well as the concentrated hydraulic losses 62, 63 substantially prevent, in case of contact filling, the gas present in chamber 40 to move towards chamber 48 and vice-versa.

In other words, a preferential flow of gas intended to pressurize articles 2 is established from portion 8 of tank 6 to the inner volume of articles 2 during the pressurization of articles 2 and a preferential flow of return gas is established from the inner volume of articles 2 towards discharge 55 during the filling step, without any mixing between the two flows (as shown by the arrows in FIG. 1).

Furthermore, in case of contactless filling, the continuous flow of gas through portion 8 of tank 6 is discharged, by suitably controlling valves 42, 46, in the area between opening 21 of body 19 and mouth 11 of article 2.

In this way, it is not necessary to prepare a particular area in the filling unit 1 to discharge that continuous flow of gas.

Finally, it is apparent that modifications and variants not departing from the scope of protection of the claims may be made to filling unit 1 and to the method disclosed herein.

In particular, filling unit 1 could not comprise duct 60.

Furthermore, filling unit 1 could not comprise loss 62 or not comprise loss 63.

The pressurization and/or de-pressurization step of article 2 could not be present, in case of contact filling of article 2 with carbonated products.

Finally, in case of contactless filling, control unit 45 can set valves 42 and/or valves 46 in the respective open configurations, either with respective valves 16 in the respective closed configurations or with respective valves 16 in the respective open configurations.

The invention claimed is:

1. A filling unit for filling an article with a pourable product, the filling unit comprising:

a tank including a first region fillable with the pourable product and a second region fillable with a gas; and at least one filling device including:

a first valve configured to be set in a first open configuration that allows a fluidic connection between the first region of the tank and the article, so as to fill the article with the pourable product, or in a first closed configuration that prevents the fluidic connection between the first region and the article;

a first fluidic line for the gas from the tank and which extends from the second region of the tank towards an inner volume of the article;

a second valve configured to be set in a second open configuration that allows the flow of the gas from the tank along the first fluidic line, or in a second closed configuration that prevents the gas from the tank from flowing along the first fluidic line;

a control unit configured to set the first valve in the first closed configuration and the second valve in the second open configuration, so as to pressurize the article before filling with the pourable product;

at least one second fluidic line for a gas contained inside the article, the at least one second fluidic line being distinct from the first fluidic line and extending from a discharge area distinct from the tank towards the inner volume of the article; and at least one third valve configured to be selectively set in a third open configuration that allows the flow of the gas contained inside the article along the at least one second fluidic line, or in a third closed configuration that prevents the gas contained inside the article from flowing along the at least one second fluidic line, wherein the control unit is configured to set the first valve in the first open configuration and the third valve in the third open configuration simultaneously, such that the first valve being in the first open configuration allows the filling of the article while the third valve being in the open configuration allows the gas contained inside the article to be discharged from the article.

2. The filling unit of claim 1, wherein:

the first fluidic line has an outlet arranged opposite of the tank and in fluid connection with an opening of the filling device;

the at least one second fluidic line has an inlet arranged on one side of the filling device and in fluid connection with the opening of the filling device; and the outlet of the first fluidic line and the inlet of the at least one second fluidic line being separated from each other.

3. The filling unit of claim 1, further comprising:

a first chamber interposed along the first fluidic line; and a second chamber interposed along the at least one second fluidic line and distinct from the first chamber.

4. The filling unit of claim 3, further comprising:

a duct interposed between the first fluidic line and the at least one second fluidic line and arranged outside the filling device, and a connection point, at which the at least one second fluidic line and the duct are fluidly connected, wherein:

the at least one second fluidic line includes a portion which is interposed between the second chamber and the connection point, the filling unit further comprises:

a first concentrated hydraulic loss arranged along the portion, and a second concentrated hydraulic loss arranged along the duct, and the first and second concentrated hydraulic losses are configured to keep a given pressure difference between the first fluidic line and the at least one second fluidic line.

5. The filling unit of claim 3, wherein:

the first chamber is kept at a first pressure value greater than a second pressure value at which the second chamber is kept; and the discharge area is kept at a third pressure value, which is lower than the second pressure value, so that the gas contained inside the article flows from the second chamber to the discharge area and is substantially prevented from flowing from the second chamber to the first chamber.

6. The filling unit of claim 3, further comprising a carousel rotatable about an axis and comprising a plurality of filling devices, wherein the first chamber and the second chamber are annular about the axis.

7. The filling unit of claim 1, wherein the discharge area is a first discharge area, the filling unit further comprising:

at least one third fluidic line, which extends from a third inlet to a second discharge area, and is configured to allow the discharge of the gas contained inside the article after the completion of the filling of the article, the third inlet being in fluid connection with the opening of the filling device;

at least one fourth valve configured to be set in a fourth open configuration that allows the gas contained inside the article to flow along the at least one third fluidic line, or in a fourth closed configuration that prevents the gas contained inside the article from flowing along the at least one third fluidic line, wherein the control unit is configured to keep the fourth valve in the fourth closed configuration and the first valve in the first open configuration during the filling of the article, and configured to set the first valve in the first closed configuration and the fourth valve in the fourth open configuration so as to de-pressurize the article after the completion of the filling of the article.

8. The filling unit of claim 1, wherein the filling device includes:

a body defining a first opening fluidly connected with the first region of the tank, and a second opening opposite to the first opening;

a shutter configured to be movable between a first position in which the shutter contacts the body so as to fluidly isolate the first opening from the second opening, and a second position in which the shutter defines a passage with the body so as to allow the passage of the pourable product from the tank to the article through the second opening;

wherein the body defines at least:

a first duct, which is part of the first fluidic line and is fluidly connected with the second opening; and a second duct, which is part of the at least one second fluidic line and is fluidly connected with the second opening; and wherein:

the first duct and the second duct are fluidly distinct from one another;

the first duct and the second duct are radially outer to the shutter with respect to an axis of the body; and the body is coaxial with the article.

9. The filling unit of claim 1, further comprising a fourth valve configured to control the flow of the gas from the tank, which enters and comes out from the second region of the tank, wherein the control unit is configured to:

control the fourth valve, so as to establish a continuous flow of the gas from the tank through the second region of the tank; and set the second valve in the second open configuration, so as to discharge the gas from the tank through the second opening of the filling device and to the atmosphere.

10. The filling unit of claim 9, wherein the control unit is configured to:

set the third valve in the third open configuration, so as to discharge at least part of the gas contained inside the article through the second opening of the filling device and to the atmosphere.

* * * * *